US007040293B2

(12) United States Patent
Furukubo et al.

(10) Patent No.: US 7,040,293 B2
(45) Date of Patent: May 9, 2006

(54) FUEL INJECTION SYSTEM

(75) Inventors: Tatsumi Furukubo, Gotenba (JP); Yoshimasa Watanabe, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 11 days.

(21) Appl. No.: 10/922,852

(22) Filed: Aug. 23, 2004

(65) Prior Publication Data

US 2005/0045150 A1 Mar. 3, 2005

(30) Foreign Application Priority Data

Aug. 26, 2003 (JP) ..... 2003-301376

(51) Int. Cl.
*F02M 37/04* (2006.01)

(52) U.S. Cl. ..... 123/467; 123/514

(58) Field of Classification Search ..... 123/467, 123/514, 456, 496, 299, 300, 500, 501, 446, 123/506, 198 D
See application file for complete search history.

(56) References Cited

U.S. PATENT DOCUMENTS 3,625,192 A * 12/1971 Dreisin ..... 123/495
4,077,376 A * 3/1978 Thoma ..... 123/467
4,213,434 A * 7/1980 Vogtmann et al. ..... 123/462
4,838,231 A * 6/1989 Ganser ..... 123/467
5,201,295 A * 4/1993 Kimberley et al. ..... 123/467
6,622,702 B1 * 9/2003 Yomogida et al. ..... 123/478
6,637,409 B1 * 10/2003 Brenk et al. ..... 123/467
6,659,086 B1 * 12/2003 Rodriguez-Amaya et al. ..... 123/467

FOREIGN PATENT DOCUMENTS

JP A 11-22580 1/1999
JP A 11-22583 1/1999
JP A 11-22584 1/1999
JP A 2003-21017 1/2003

* cited by examiner

*Primary Examiner*—Carl S. Miller
(74) *Attorney, Agent, or Firm*—Oliff & Berridge, PLC

(57) ABSTRACT

A fuel injection system (10) with reduced pressure pulsations in the fuel discharge paths from the injectors is disclosed. A high-pressure fuel accumulated in a common rail is injected by a plurality of the injectors. Each injector includes a high-pressure chamber for accumulating the fuel, a back pressure chamber into which the high-pressure fuel is introduced from the high-pressure chamber and a nozzle body arranged in the high pressure chamber. Each injector closes the fuel injection port by pushing down the nozzle body under the pressure of the high-pressure fuel introduced into the back pressure chamber. The fuel injection port is opened, on the other hand, by discharging the high-pressure fuel from the back pressure chamber through the fuel discharge path of each injector. A variable-area orifice (6) is arranged in the discharge path (55) downstream of the confluence at which all the fuel discharge paths from the injectors are merged with each other. The higher the fuel pressure in the discharge paths, the larger the open area of the variable-area orifice. Thus, a pressure pulsation in the fuel discharge paths from the injectors is reduced.

11 Claims, 8 Drawing Sheets

FUEL INJECTION SYSTEM

BACKGROUND OF THE INVENTION

1. Field of the Invention

The present invention relates to a fuel injection system or, in particular, to a fuel injection system employed in a diesel engine.

2. Description of the Related Art

Generally, an accumulator (common-rail) fuel injection system has such a configuration that high-pressure fuel, supplied from a high-pressure chamber, is introduced into a control chamber arranged in a fuel injection valve and a nozzle body is lowered to maintain a fuel injection port in closed state. Further, the fuel in the control chamber is allowed to leak into fuel discharge paths so that the internal pressure of the control chamber is reduced thereby to raise the nozzle body, with the result that the fuel injection port is opened to inject the fuel (see, for example, Japanese Unexamined Patent Publications. Nos. 2003-021017, 11-022580, 11-022583 and 11-022584).

In order to inject a predetermined amount of fuel within a short time, the fuel in the control chamber must be discharged in one operation into the fuel discharge paths at the sacrifice of a pressure pulsation caused in the fuel discharge paths. Normally, a check valve is arranged in the discharge path downstream of each injector, and a pressure pulsation may be caused also by the operation of a check valve. A sustained pressure pulsation in the fuel discharge paths will change the force acting on the control valve, etc. and adversely affects the operation of the nozzle body, thereby changing the amount of fuel injected.

Especially in the case where the interval is short between one injection and another, the fuel may be injected during a large pressure pulsation caused, in the fuel discharge path, by the preceding injection. In such a case, if the time when the pressure in the fuel discharge path drops coincides with the injection timing of the injector, the force acting on the control valve is reduced and the control valve lifts at a higher rate, and the fuel is rapidly discharged from the control chamber. Thus, the nozzle body rises rapidly, often resulting in the injected fuel amount being increased beyond the desired amount. In the case where the time when the internal pressure of the fuel discharge path rises coincides with the injection timing of the injector, on the contrary, the amount of fuel injected is liable to be smaller than required.

Further, the recent trend toward the employment of a pilot injection before the main injection and a post injection after the main injection has further shortened the interval between injections. This increases the possibility of frequent changes or variations in the amount of fuel injected. Also, an increased pressure pulsation in each fuel discharge path is accompanied by frequent cavitation and promotes the erosion of the actuator chamber of the actuator for controlling the control valve, thereby leading to a shorter service life of the parts. Although the pressure pulsation is attenuated by a longer distance, of the fuel discharge path, between the injectors, the recent demand for a smaller fuel injection system makes it difficult to shorten the distance of each fuel discharge path between the injectors to such a degree as to completely attenuate the pressure pulsation.

This invention has been achieved in view of this situation, and the object thereof is to provide a fuel injection system, for an internal combustion engine, in which the pressure pulsation in the fuel discharge paths from the injectors is reduced while, at the same time, suppressing the variations in the amount of fuel injected from each injector.

SUMMARY OF THE INVENTION

In order to achieve the object described above, according to a first aspect of the invention, there is provided a fuel injection system, for an internal combustion engine, for injecting a high-pressure fuel accumulated in a common rail from a plurality of injectors, wherein each of the injectors includes a high-pressure chamber for accumulating the fuel, a back pressure chamber into which the high-pressure fuel in the high-pressure chamber is introduced and a nozzle body arranged in the high pressure chamber, wherein the injector closes the fuel injection port by pushing down the nozzle body under the pressure of the high-pressure fuel introduced into the back pressure chamber, on the one hand, and the high-pressure fuel in the back pressure chamber is discharged through the fuel discharge path of the injector thereby to open the fuel injection port, on the other hand, wherein a variable-area orifice is arranged in a common discharge path downstream of the confluence of all the fuel discharge paths from the injectors, and wherein the open area of the variable-area orifice is increased with an increase in fuel pressure in the common discharge path.

In the first aspect of the invention, the open area of the variable-area orifice is changed by the fuel pressure. Unlike in the prior art using a check valve, therefore, the fuel is prevented from being discharged in one operation and therefore the pressure in the common discharge path does not undergo a sudden change. As a result, the pressure pulsation in the discharge paths is reduced when the high-pressure fuel is discharged from the control chamber, and the amount of the fuel injected from each injector can be stabilized.

According to a second aspect of the invention, there is provided a fuel injection system, for an internal combustion engine in the first aspect of the invention, further comprising a variable-area orifice arranged in each of the fuel discharge paths from the injectors wherein the open areas of the variable-area orifices are increased with an increase in fuel pressure in the fuel discharge paths.

Specifically, in the second aspect of the invention, the pressure pulsation in the common fuel discharge path caused at the time of fuel injection by a given injector can be prevented from being transmitted to an adjacent injector, and therefore the change in the amount of fuel injected by the injectors can be further suppressed.

According to a third aspect of the invention, there is provided a fuel injection system, of an internal combustion engine in the first or second aspect of the invention, wherein the variable-area orifice is formed of a first chamber communicating with the injectors and a second chamber integrated with the first chamber and including an outlet, wherein the variable-area orifice includes a sliding member adapted to slide along the inner wall of the first chamber, and at least one communication hole is formed in the sliding surface of the sliding member for establishing communication between the first chamber and the second chamber at the time of sliding of the sliding member, wherein said variable-area orifice includes an urging means to urge the sliding means away from the second chamber, and wherein the open area of the communication hole is increased when the sliding member slides toward the second chamber, under the pressure of the fuel in the fuel discharge path, against the force of the urging means.

Specifically, in the third aspect of the invention, the open area of the variable-area orifice is gradually increased in accordance with the sliding distance of the sliding member, and therefore the pressure pulsation can be easily reduced.

According to a fourth aspect of the invention, there is provided a fuel injection system for an internal combustion engine in the third aspect of the invention, wherein a plurality of communication holes are formed to establish communication between the first chamber and the second chamber, the communication holes in the sliding surface of said sliding member each being in the shape of circle, and wherein the inner edge of at least one of the plurality of the communication holes in the sliding surface of said sliding member and the outer edge of an adjacent communication hole in the sliding surface of the sliding member are located at substantially the same position in the sliding direction in which the sliding member slides.

Specifically, in the fourth aspect of the invention, as the communication holes in the sliding surface of the sliding member are circular in shape, the communication holes can be easily formed, and the open area of the variable-area orifice can be continuously increased when the sliding member slides, thereby making it possible to prevent hunting.

According to a fifth aspect of the invention, there is provided a fuel injection system, for an internal combustion engine in the third aspect of the invention, wherein the communication hole is at least a slit extending in the sliding direction.

Specifically, in the fifth aspect of the invention, the communication hole can be formed by only one machining operation and therefore can be formed in a short time.

According to a sixth aspect of the invention, there is provided a fuel injection system, for an internal combustion engine in any one of the third to fifth aspects of the invention, wherein the increasing rate of the open area of each communication hole increases with an increase in the sliding distance of the sliding member.

Specifically, in the sixth aspect of the invention, even in the case where the open area of the variable-area orifice is substantially a maximum, the sliding member can be slid in stable fashion in the first chamber. Also, the shortened sliding distance of the sliding member can rapidly deal with a sharp pressure increase which may occur, while at the same time reducing the size of the variable-area orifice as a whole.

According to a seventh aspect of the invention, there is provided a fuel injection system, for an internal combustion engine in the third aspect of the invention, wherein the open area of the variable-area orifice is changed by at least one of the number, shape and size of the communication holes formed in the sliding surface of the sliding member.

Specifically, the seventh aspect of the invention can produce the same functions and effects as the aforementioned aspects.

According to an eighth aspect of the invention, there is provided a fuel injection system, for an internal combustion engine in the first or second aspect of the invention, wherein the variable-area orifice is formed of a first chamber communicating the injectors and a second chamber integrated with the first chamber and including an outlet, the variable-area orifice includes a sliding member adapted to slide along the inner wall of the first chamber, at least one of the inner wall of the first chamber and the sliding surface of the sliding member is tapered, and said variable-area orifice includes an urging means to urge the sliding means away from the second chamber, and wherein when the sliding member slides toward the second chamber under the pressure of the fuel in the fuel discharge path against the force of the urging means, the clearance between the inner wall of the first chamber and the sliding surface of the sliding member is increased.

Specifically, in the eighth aspect of the invention, the clearance between the sliding member and the inner wall of the first chamber, i.e. the open area of the variable-area orifice is adapted to increase gradually in accordance with the sliding distance of the sliding member and, therefore, the pressure pulsation can be easily reduced.

According to a ninth aspect of the invention, there is provided a fuel injection system, for an internal combustion engine in any one of the third to eighth aspects of the invention, wherein the second chamber is larger than the first chamber, and the sliding member includes a flange adapted to sealably abut the step between the first chamber and the second chamber.

Specifically, in the ninth aspect of the invention, the first chamber and the second chamber can be substantially sealed as long as the flange is in engagement with the step. In the case where the fuel pressure in each fuel discharge path is lower than a predetermined value, during the assembly in the factory or a shortage of gasoline, the fuel is prevented from leaking and, at the same time, the fuel pressure quickly increases to a predetermined level.

According to a tenth aspect of the invention, there is provided a fuel injection system, for an internal combustion engine in any one of the third to ninth aspects of the invention, wherein the sliding member of the variable-area orifice is controlled by a drive member.

Specifically, in the tenth aspect of the invention, the position of the sliding member can be controlled very accurately. The drive member may be an electromagnetic solenoid or a piezoelectric actuator.

According to a eleventh aspect of the invention, there is provided a fuel injection system for an internal engine in the first or second aspect of the invention, wherein said variable-area orifice is formed of a first chamber communicating with said injectors and a second chamber integrated with said first chamber and including an outlet, wherein said variable-area orifice includes a sliding member adapted to slide along the inner wall of said first chamber, and at least one communication hole of a communication passage is formed in the inner wall of said first chamber for establishing communication between said first chamber and said second chamber at the time of sliding of said sliding member, wherein said variable-area orifice includes an urging means to urge the sliding means away from the second chamber, and wherein the open area of said communication hole is increased when said sliding member slides toward said second chamber under the pressure of the fuel in said fuel discharge path against the force of said urging means.

DESCRIPTION OF THE PREFERRED EMBODIMENTS

Figure 1:
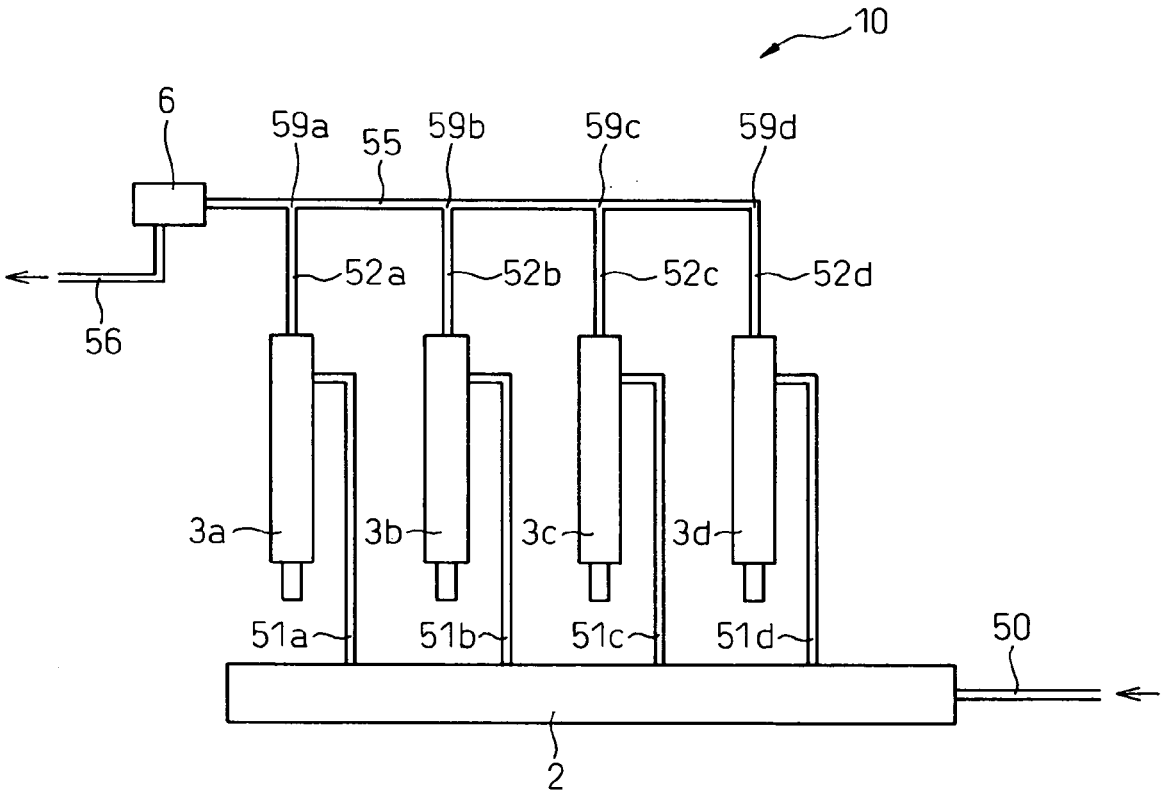
FIG. 1 is a schematic diagram showing a fuel injection system of an internal combustion engine according to this invention.

Embodiments of the invention are explained below with reference to the accompanying drawings. In the drawings, similar or identical component members are designated by the same reference numerals, respectively. To facilitate understanding, the drawings are appropriately scaled.

FIG. 1 is a schematic diagram showing a fuel injection system of an internal combustion engine according to this invention. As shown in FIG. 1, a fuel injection system 10 includes a common rail 2. The fuel from a fuel tank, which is not shown, is supplied to the common rail 2 through a pipe 50 by the operation of a pump which is not shown. As shown, the fuel injection system 10 includes a plurality of injectors 3, or four injectors 3*a* to 3*d* in the case of FIG. 1. The injectors 3*a* to 3*d* are connected to a plurality of pipes 51*a* to 51*d* extending from the common rail 2, respectively. The fuel is injected from the forward end of each injector. Also, the fuel leaking at the time of injection from the injectors 3 and the fuel leaking from the sliding member of each injector 3 flow into a common fuel discharge path 55 through fuel discharge branch pipes 52*a* to 52*d* connected to the injectors 3*a* to 3*d*, respectively, and through a fuel return path 56 connected to the common fuel discharge path 55, return to the fuel tank (not shown).

Figure 2:
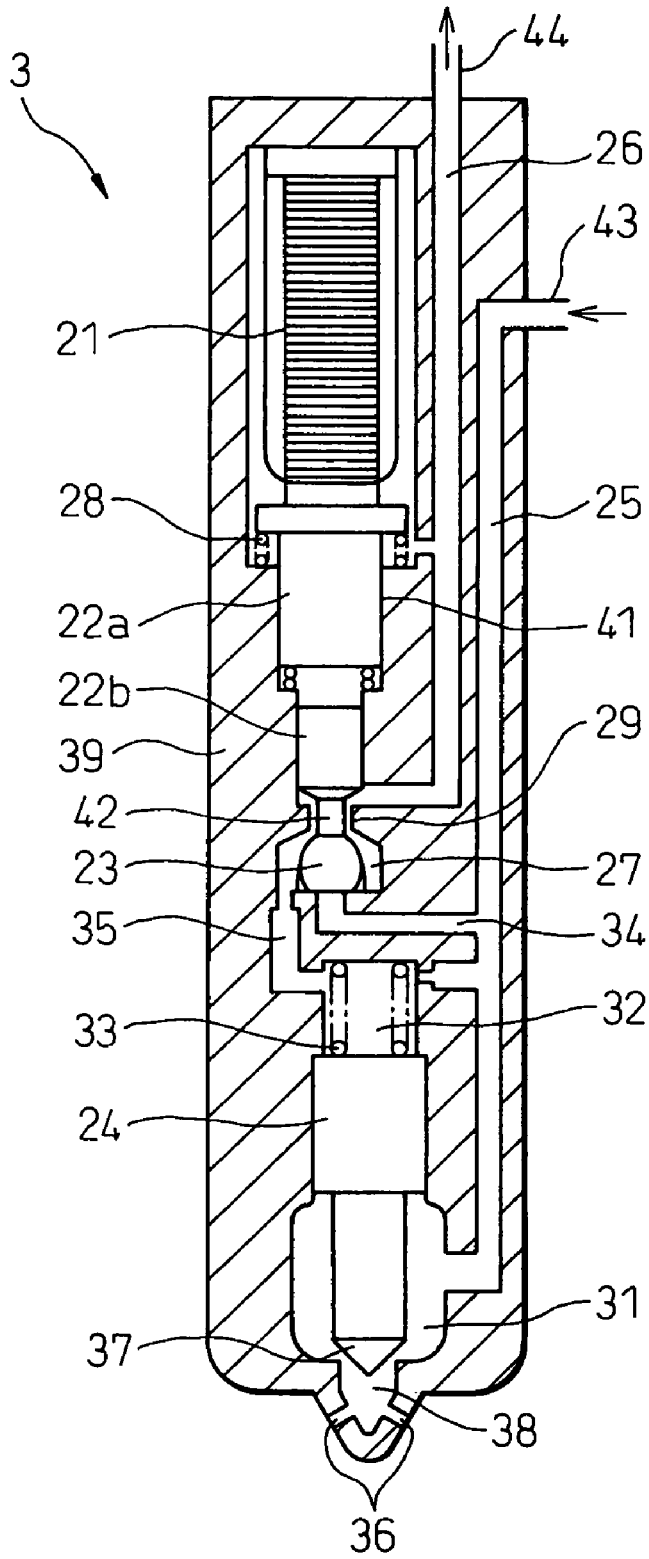
FIG. 2 is a substantially longitudinal sectional view of the injector of the fuel inspection system according to the invention.

FIG. 2 is a substantially longitudinal sectional view of the injector of the fuel injection system according to this invention. The injector 3 shown in FIG. 2 represents a typical one of the injectors 3*a* to 3*d* shown in FIG. 1, and the parts of the injector 3 shown in FIG. 2 are also included in each of the injectors 3*a* to 3*d*. A piezoelectric element 21 such as a piezoelectric actuator is arranged in the casing 39 of the injector 3 and connected to an electronic control unit ECU (not shown). The piezoelectric element 21 has the function of causing a first piston 22*a* arranged in a chamber 41 to slide into the chamber 41 against the force of a spring 28. A second piston 22*b* located under the first piston 22*a* includes an extension 42 inserted into a leak port 29. The leak port 29 communicates with an in-casing return path 26 formed in the casing 39. Further, as shown in FIG. 2, the lower end of the extension 42 is connected with a valve body 23 of a control valve arranged in a control valve chamber 27. The control valve chamber 27 communicates with a back pressure chamber 32 through a high-pressure path 35. In the back pressure chamber 32, a nozzle body 24 is slidably arranged. As shown, a spring 33 is arranged in the back pressure chamber 32 and urges the nozzle body 24 downward. The forward end 37 of the nozzle body 24 and the neighborhood thereof are arranged in a high-pressure chamber 31, and the forward end 37 of the nozzle body 24 functions to open and close the forward end hole 38 of the casing 39. This forward end hole 38 further includes an injection hole 36. Further, as can be understood from FIG. 2, the high-pressure chamber 31 communicates with an inlet path 25. In similar fashion, the control valve chamber 27 also communicates with the inlet path 25 through another high-pressure path 34. The inlet path 25 in the injector 3 is assumed to communicate with the pipes 51*a* to 51*d* shown in FIG. 1 through the inlet 43. The fluid such as the fuel that has flowed into the inlet path 25 from the inlet 43 is injected from the injection port 36. Part of the fuel thus injected flows out of the outlet 44 of the casing 39 through the in-casing return path 26. Normally, these paths and chambers of the injector 3 are filled with the fuel. The in-casing return path 26 communicates with the fuel discharge branch pipes 52*a* to 52*d* shown in FIG. 1.

When the injector 3 is turned off, i.e. when no fuel is injected from the injection port 36, the power supply to the piezoelectric element 21 is cut off by the electronic control unit ECU (not shown). Therefore, the piezoelectric element 21 cannot be displaced and the first piston 22*a* is urged upward by the spring 28. As a result, the valve body 23 is pushed up by the high-pressure fuel from the high-pressure path 34, and the leak port 29 is closed. Thus, the back pressure acting on the back pressure chamber 32 of the nozzle body 24 comes into equilibrium with the internal pressure of the high-pressure chamber 31, and the nozzle body 24 is pushed down by the spring 33 so that the forward end 37 of the nozzle body 24 closes the forward end hole 38 of the casing 39.

In the case where the injector 3 is in operation, i.e. in the case where fuel is being injected from the injection hole 36 as shown in FIG. 2, on the other hand, power is supplied to the piezoelectric element 21 by the ECU and therefore the piezoelectric element 21 pushes down the first piston 22*a* against the force of the spring 28. Thus, the second piston 22*b* moves down and the valve body 23 also moves down, thereby opening the leak port 29. Thus, the fuel whose pressure has far acted on the back pressure chamber 32 of the nozzle body 24 reaches the in-casing return path 26 through the high-pressure path 35, the control valve chamber 27 and the leak port 29, and flows out from the outlet 44 of the casing 39. Under the pressure in the high-pressure chamber 31 of the nozzle body 24, the nozzle body 24 moves up. The forward end hole 38 of the casing 39 opens and the fuel is injected from the injection hole 36 of the high-pressure chamber 31. In view of the fact that part of the fuel that has passed through the leak port 29 also flows in the chamber containing the piezoelectric element 21, the piezoelectric element 21 can also be cooled.

Referring to FIG. 1 again, the fuel discharge branch pipes 52*a* to 52*d* communicating with the in-casing return path 26 in the injector 3 are merged into the common fuel discharge path 55 at the confluences 59*a* to 59*d*, respectively. As shown in FIG. 1, a variable-area orifice 6 is arranged downstream of the confluences 59*a* to 59*d* in the common fuel discharge path 55. The fuel return path 56 extending downstream of the variable-area orifice 6 is connected to the fuel tank which is not shown.

Figure 3:
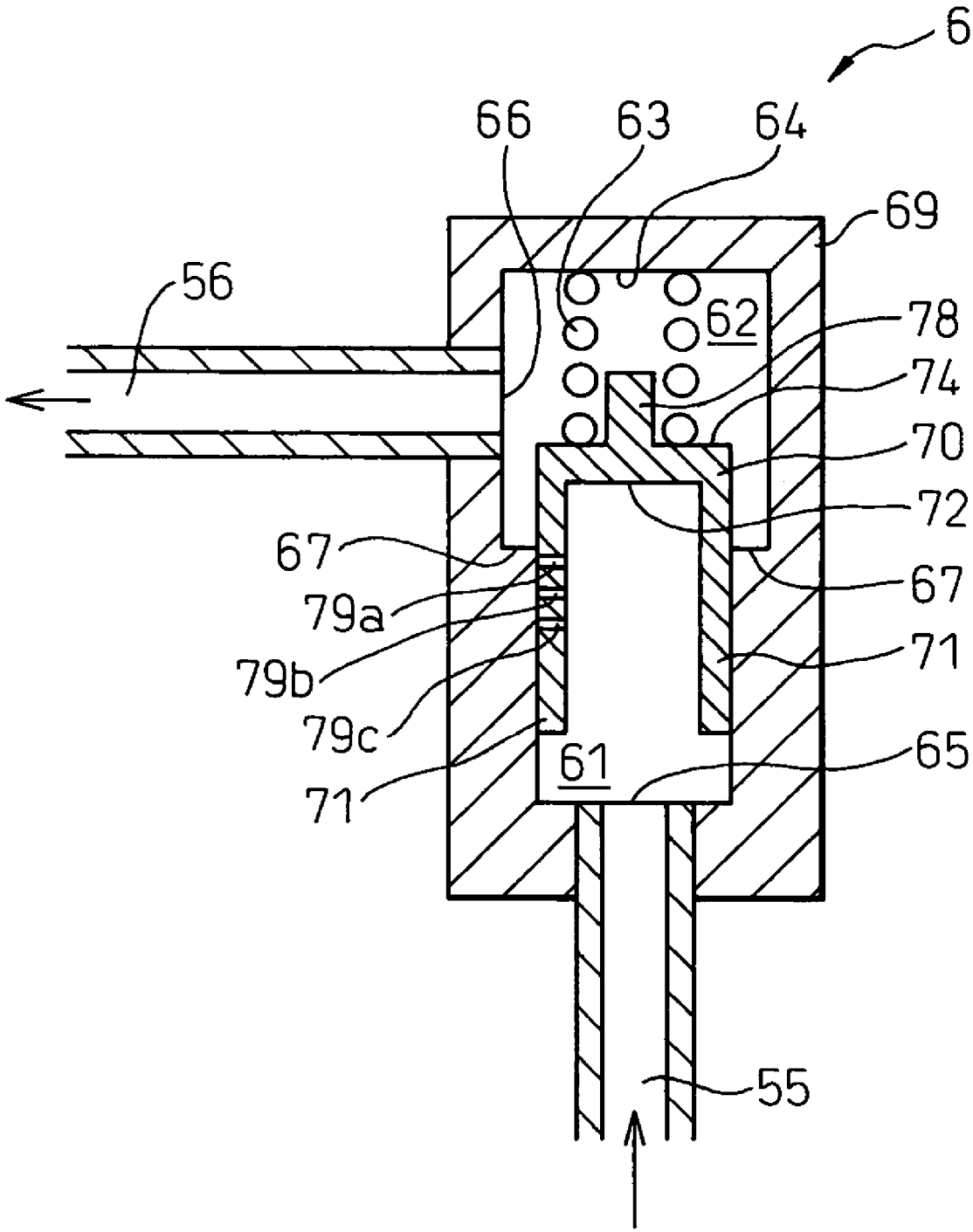
FIG. 3 is a substantially longitudinal sectional view of the variable-area orifice according to a first embodiment of the invention.

FIG. 3 is a substantially longitudinal sectional view of the variable-area orifice according to the first embodiment of the invention. A first chamber 61 and a second chamber 62 are formed in the casing 69 of the variable-area orifice 6. The first chamber 61 and the second chamber 62 are normally filled with the fuel flowing from the common fuel discharge path 55. The first chamber 61 communicates with the common fuel discharge path 55 through the inlet 65, and the second chamber 62 communicates with the fuel return path 56 through the outlet 66. As shown in FIG. 3, the first chamber 61 and the second chamber 62 are formed integrally with each other, and the second chamber 62 is shown to be larger than the first chamber 61 in FIG. 3. Therefore, a step 67 is formed between the first chamber 61 and the second chamber 62. Further, a sliding member 70 is arranged to slide along the inner wall of the first chamber 61 of the variable-area orifice 6. According to the third embodiment shown in FIG. 3, the sliding member 70 is substantially cylindrical, and the outer size of the sliding member 70 is substantially equal to the inner size of the first chamber 61. As shown in FIG. 3, the sliding member 70 has a substantially U-shaped cross section as viewed from a direction in which it slides. The sliding member 70 is arranged in such a position that the fuel from the common fuel discharge path 55 can flow in the sliding member 70 along the side wall 71 of the sliding member 70 and reach the bottom 72 of the sliding member 70. Also, an urging member or a spring 63 in FIG. 3 is arranged in the second chamber 62. As shown in FIG. 3, the spring 63 is arranged between the inner surface 64 of the second chamber 62 and the end surface 74 of the sliding member 70 on the opposite side of the bottom 72, and functions to urge the sliding member 70 toward the common fuel discharge path 55, i.e. toward the injector 3. As shown in FIG. 3, the spring 63 preferably engages the protrusion 78 extending from the end surface 74 of the sliding member 70, whereby the spring 63 is prevented from being displaced out of the space between the inner surface 64 of the second chamber 62 and the end surface 74 of the sliding member 70 when the sliding member 70 is in a sliding operation.

Further, as shown in FIG. 3, a plurality of communication holes or, in the case of FIG. 3, three communication holes 79*a*, 79*b*, 79*c* are formed in the side wall 71 of the sliding member 70. As shown in FIG. 3, the three communication holes 79*a*, 79*b* and 79*c* are formed, in that order, in the direction from the second chamber 62 toward the first chamber 61. The communication holes 79*a* to 79*c* function to establish communication between the first chamber 61 and the second chamber 62 in accordance with the sliding position of the sliding member 70. Although the number of the communication holes 79*a* to 79*c* shown in FIG. 3 is three, the number, shape and arrangement of the communication holes are not limited to those of the embodiment shown in FIG. 3, as described later.

The operation of the variable-area orifice 6 is explained below. As described above with reference to FIG. 2, at the time of fuel injection from the injector 3, the valve body 23 rises and the high-pressure fuel in the control valve chamber 27 reaches the variable-area orifice 6 through the in-casing return path 26, the pipe 52 (see FIG. 1) and the common fuel discharge path 55. In accordance with the magnitude of this pressure, the fuel in the first chamber 61 of the variable-area orifice 6 urges the sliding member 70 toward the second chamber 62 against the force of the spring 63. As a result, the plurality of communication holes 79*a* to 79*c* formed in the side wall 71 of the sliding member 70 are opened in accordance with the magnitude of the fuel pressure. Specifically, in the case where the pressure of the fuel that has reached to the first chamber 61, i.e. the return back pressure in the control valve chamber 27 of the injector 3, is low, the sliding distance of the sliding member 70 is short and therefore only the first communication hole 79*a* of the communication holes 79*a* to 79*c* opens but not the other communication holes. In the case where the return back pressure is high, on the other hand, the resultant long sliding distance of the sliding member 70 opens all the communication holes 79*a* to 79*c*. With the opening of the communication holes, the fuel in the first chamber 61 flows into the second chamber 62 and through the fuel return path 56, returns into the fuel tank which is not shown. In this way, according to this invention, in accordance with the sliding distance of the sliding member 70, i.e. in accordance with the magnitude of the return back pressure, the open area of the variable-area orifice 6 changes. In other words, the higher the return back pressure, the larger the open area of the variable-area orifice 6.

According to this invention, the variable-area orifice 6 is arranged downstream of the confluences 59*a* to 59*d* where the branch pipes 52*a* to 52*d* from the injectors 3*a* to 3*d* are merged into the common fuel discharge path 55, and therefore the fuel is not supplied in one operation unlike in the prior art employing a check valve. Therefore, the pressure in the common discharge path is prevented from undergoing a sudden change. As a result, the pressure pulsation in the discharge path is reduced, and the variations in the amount of fuel injected from each injector is suppressed. Also, cavitation is prevented in the fuel return path 56, thereby reducing the erosion in the control valve chamber 27.

Figure 4A:
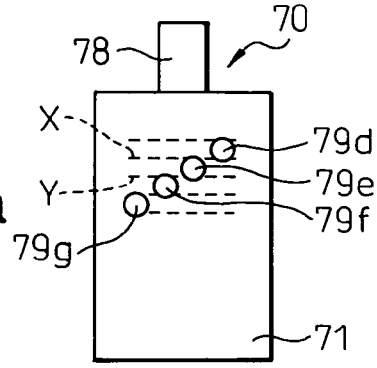
FIG. 4*a* is a side view showing an example of an applicable sliding member.

FIGS. 4*a* to 4*e* are side views showing applicable examples of the sliding member. The side wall 71 of the sliding member 70 shown in FIG. 4*a* is formed with four circular communication holes 79*d* to 79*g*. The communication holes, though not limited in shape, can be easily formed in the side wall 71 if they are circular as shown. Adjacent two communication holes of the communication holes 79*d* to 79*g*, for example, communication holes 79*d* and 79*e* are considered. As shown in FIG. 4*a*, the edge of the communication hole 79*e* near to the inlet 65 of the first chamber 61 and the edge of the communication hole 79*d* near to the protrusion 78 are located on the line segment X perpendicular to the direction in which the sliding member 70 slides. In a similar fashion, the edge of the communication hole 79*f* near to the inlet 65 of the first chamber 61 and the edge of the communication hole 79*e* near to the protrusion 78 are located on the line segment Y perpendicular to the direction in which the sliding member 70 slides. The other adjacent ones of the communication holes are also similarly located. According to the embodiment shown in FIG. 4*a*, with the sliding operation of the sliding member 70, the communication hole 79*e*, for example, begins to open substantially at the same time as the communication hole 79*d* comes into completely open state. When the sliding member 70 continuously slides toward the second chamber 62, therefore, the open area of the variable-area orifice 6 also increases continuously. Specifically, in the embodiment shown in FIG. 4*a*, the open area of the variable-area orifice 6 never becomes constant and therefore hunting is prevented when the system is driven.

Figure 4B:
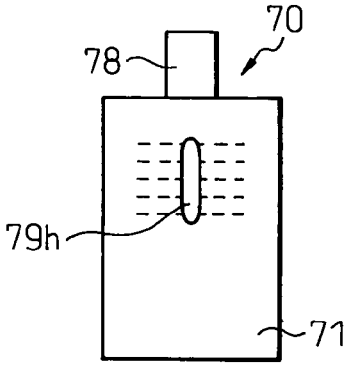
FIG. 4*b* is a side view showing another example of an applicable sliding member.

FIG. 4*b* is a side view showing another applicable example of the sliding member. In FIG. 4*b*, a slit-like single communication hole 79*h* extending along the direction in which the sliding member 70 slides is formed in the side wall 71 of the sliding member 70. In this case, the communication hole 79*h* can be easily formed in a single machining operation. Also, the open area of the variable-area orifice 6 continuously changes while the sliding member 70 slides continuously, and therefore the same effects as in the embodiment shown in FIG. 4*a* can be produced.

Figure 4C:
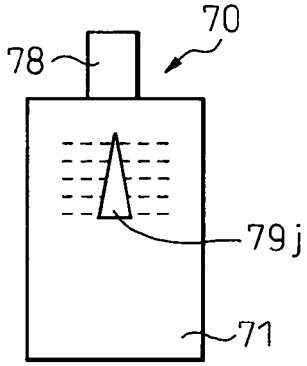
FIG. 4*c* is a side view showing still another example of an applicable sliding member.
Figure 4D:
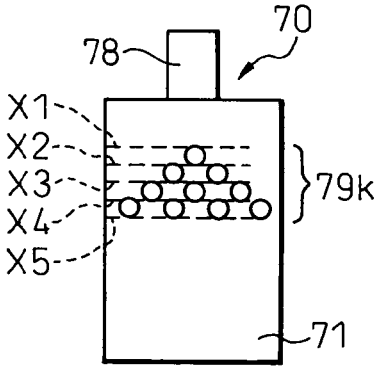
FIG. 4*d* is a side view showing yet another example of an applicable sliding member.
Figure 4E:
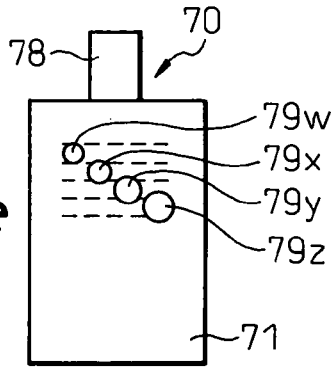
FIG. 4*e* is a side view showing a further example of an applicable sliding member.

FIGS. 4*c* to 4*e* are side views showing other applicable examples of the sliding member. In FIGS. 4*c* to 4*e*, the slide movement of the sliding member 70 toward the second chamber 62 sharply increases the open area of the variable-area orifice 6. Specifically, in FIG. 4*b*, the open area of the variable-area orifice 6 increases linearly in accordance with the sliding distance of the sliding member 70, while in FIGS. 4*c* to 4*e*, the open area of the variable-area orifice 6 increases exponentially in accordance with the sliding distance of the sliding member 70.

In FIG. 4*c*, a single communication hole 79*j* extending along the direction in which the sliding member 70 slides is formed in the side wall 71 of the sliding member 70. This communication hole 79*j* is substantially in the shape of triangle with the top thereof located near to the protrusion 78 of the sliding member 70 and the bottom side thereof located near to the inlet 65 of the first chamber 61. Also, in FIG. 4*d*, a plurality of communication holes 79*k* having the same shape are formed. As shown in FIG. 4*d*, the line segments perpendicular to the direction in which the sliding member 70 slides are designated as X1 to X5 in the ascending order of distance from the protrusion 78 of the sliding member 70. As shown, one communication hole is formed between the line segment X1 nearest to the protrusion 78 of the sliding member 70 and the adjacent line segment X2, two communication holes are formed between the line segment X2 and the line segment X3, and three communication holes are formed between the line segments X3 and X4. Further, four communication holes are formed between the line segments X4 and X5. Specifically, according to the embodiment shown in FIG. 4*d*, the longer the distance from the protrusion 78 of the sliding member 70, the more communication holes are formed. Further, in FIG. 4*e*, four communication holes 79*w* to 79*z* are formed. As shown in FIG. 4*e*, for example, a communication hole near to the inlet 65 of the first chamber 61, such as the communication hole 79*x*, has a larger diameter than a communication hole near to the protrusion 78 of the sliding member 70, such as the communication hole 79*w*. As can be understood from FIG. 4*e*, a communication hole nearer to the inlet 65 of the first chamber 61 has a larger diameter. As shown in FIGS. 4*c* to 4*e*, the larger the open area of the variable-area orifice 6, the longer the distance of the sliding member 70. Even in the case where the open area is near the maximum, the sliding distance of the sliding member 70 is comparatively short, and therefore the sliding member can be slid in stable fashion. For the same reason, the sliding member 70 and, hence, the whole of the variable-area orifice 6, can be reduced.

Figure 5:
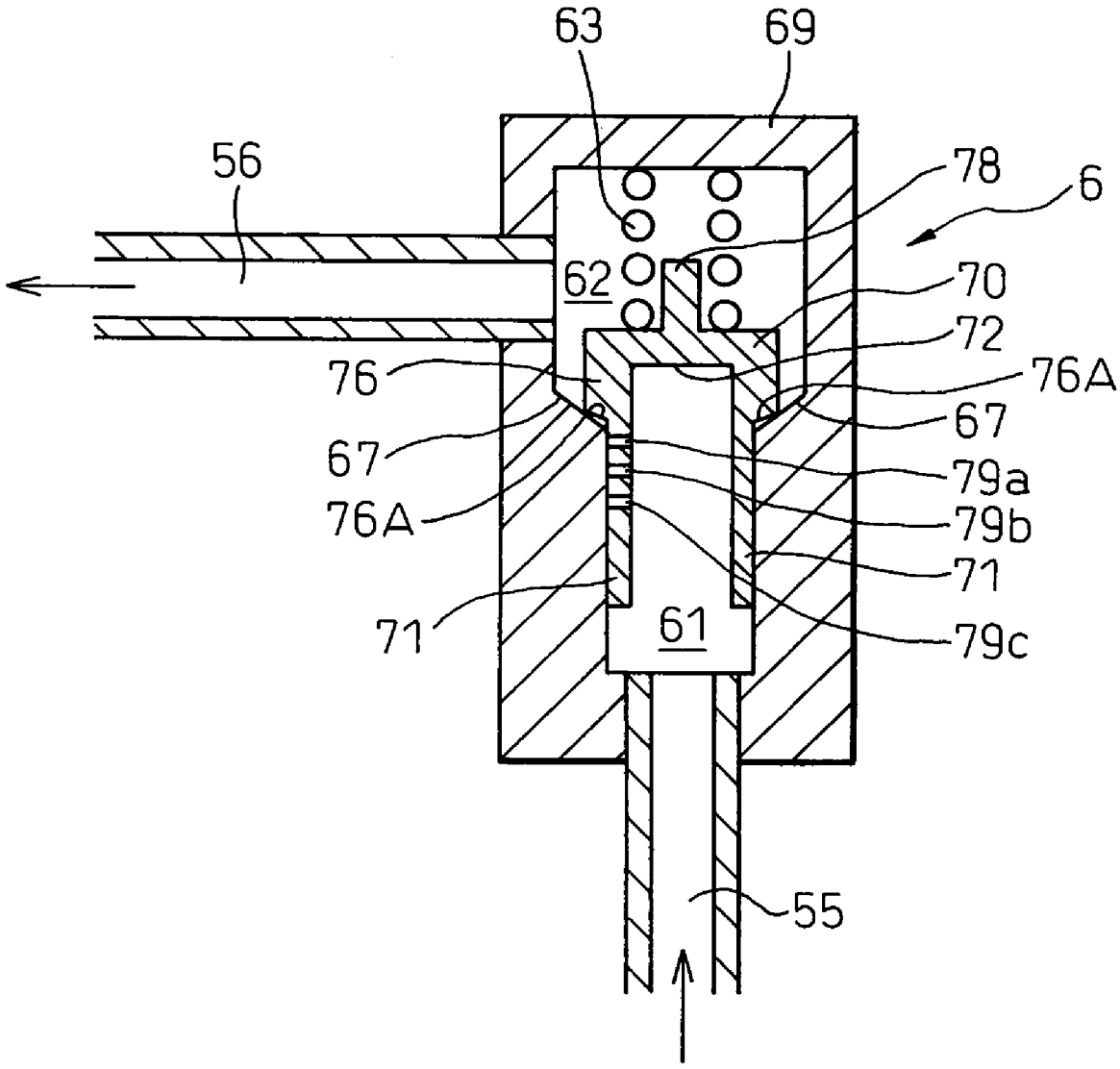
FIG. 5 is a substantially longitudinal sectional view of the variable-area orifice according to a second embodiment of the invention.

FIG. 5 is a substantially longitudinal sectional view of the variable-area orifice according to a second embodiment of the invention. In FIG. 5, a flange 76 is formed on the outer surface of the side wall 71 nearer to the protrusion 78 of the sliding member 70. As shown in FIG. 5, the flange 76 is larger than the inner diameter of the first chamber 61 and, therefore, the portion of the sliding member 70 formed with the flange 76 never slides in the first chamber 61 but always remains in the second chamber 62. FIG. 5 shows the case in which the open area of the variable-area orifice 6 is zero. In this case, the flange 76 of the sliding member 70 is adapted to sealably abut the step 67 between the first chamber 61 and the second chamber 62. In normal operation, the first chamber 61 and the second chamber 62 are filled with the fuel. In the case where the variable-area orifice 6 is first used, such as at the time of assembly of the variable-area orifice 6 in the factory or when the gasoline is in short supply, however, neither the first chamber 61 or the second chamber 62 is filled with fuel. As long as the sliding member 70 is movable along the inner wall of the first chamber 61, the fuel may leak, though slightly, from the gap between the sliding member 70 and the inner wall of the first chamber 61 even in the case where internal fuel pressure of the first chamber 61 is lower than a predetermined value. In the absence of the flange 76 of the sliding member 70, therefore, a very long time is required to fill the fuel in the first chamber 61 and the second chamber 62. In the case where the sliding member 70 includes the flange 76 as shown in FIG. 5, however, the clearance between the end surface 76A of the flange 76 and the step 67 is sealed when the fuel pressure in the first chamber 61 is lower than a predetermined value. Thus, the fuel is prevented from leaking from the first chamber 61. At the time of initial use of the variable-area orifice 6, therefore, the fuel pressure can be quickly increased to a predetermined value.

In FIG. 5, the step 67 is formed inclined between the first chamber 61 and the second chamber 62. In the case where the end surface 76A of the flange 76 formed on the sliding member 70 is adapted to abut the step 67 sealably, however, the shape of the step 67 and the flange 76 is not limited to the shape shown in FIG. 5.

Figure 6:
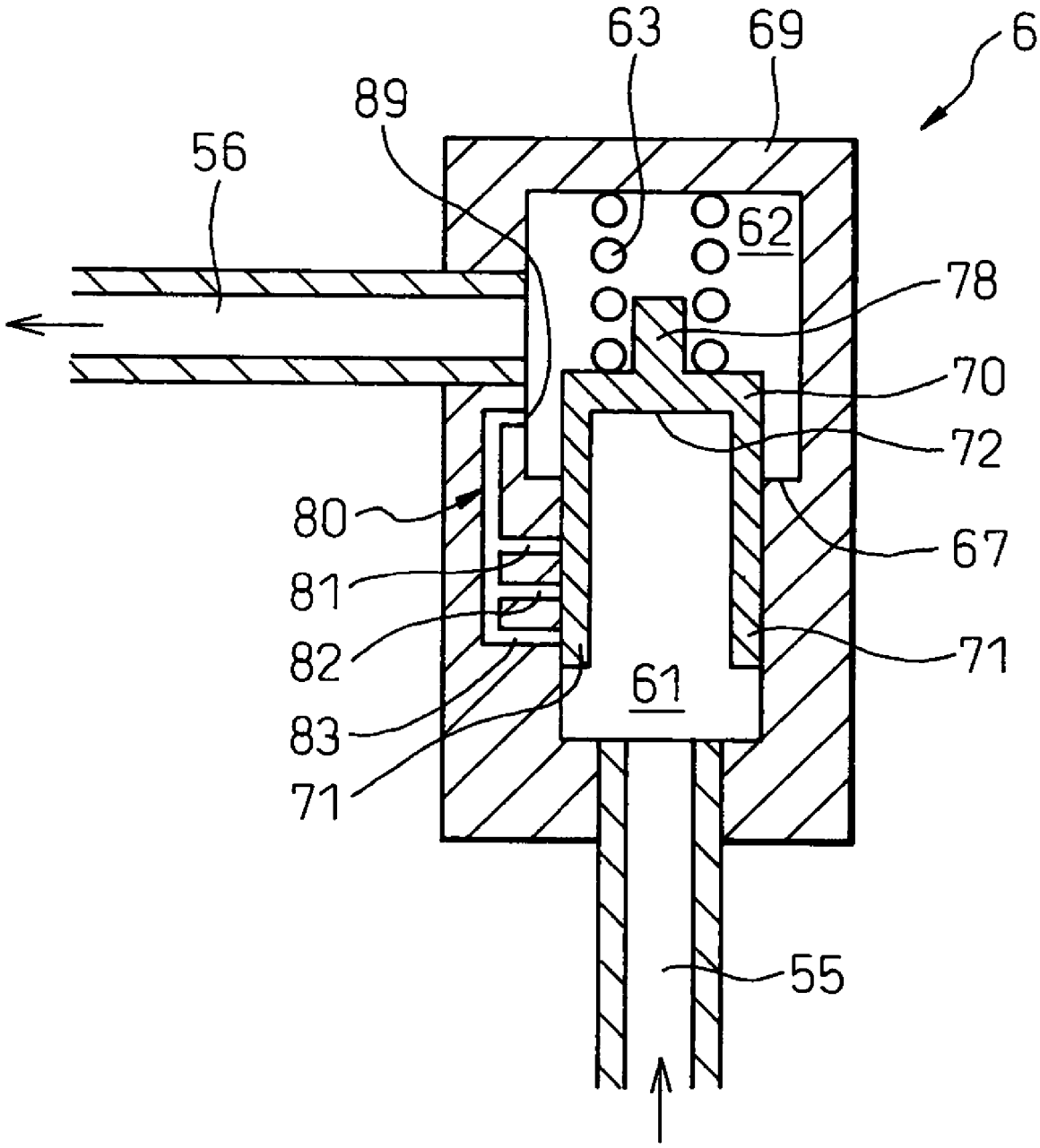
FIG. 6 is a substantially longitudinal sectional view of the variable-area orifice according to still another embodiment of the invention.

FIG. 6 is a substantially longitudinal sectional view of the variable-area orifice according to another embodiment of the invention. In the embodiment described above, the communication hole 79 is formed in the side wall 71 of the sliding member 70. In the embodiment shown in FIG. 6, however, a communication hole 80 for establishing communication between the first chamber 61 and the second chamber 62 is formed in the casing 69. As shown in FIG. 6, the communication hole 80 extending from the inlet 89 formed in the second chamber 62 into the casing 69 branches to a plurality of branches, or three branches 81, 82, 83 in the case of FIG. 6, at a point near the first chamber 61. The branches 81, 82, 83 shown in FIG. 6 are formed, in that order, away from the second chamber 62. Once the fuel pressure in the first chamber 61 increases and the sliding member 70 begins to slide toward the second chamber 62 against the force of the spring 63, the branch path 83 opens first of all. With the further increase in fuel pressure, the sliding member 70 further slides so that the communication hole 82 and then the communication hole 81 open. Specifically, in accordance with the sliding distance, the open area of the variable-area orifice is enlarged, and, therefore, the same effects as in the embodiment described above are produced. Although the three branches 81, 82, 83 are shown in FIG. 6, the number and shape of the branches are not limited to those shown in FIG. 6, and the cross section of the branches may correspond to the shape of the communication holes shown in FIG. 4.

Figure 7A:
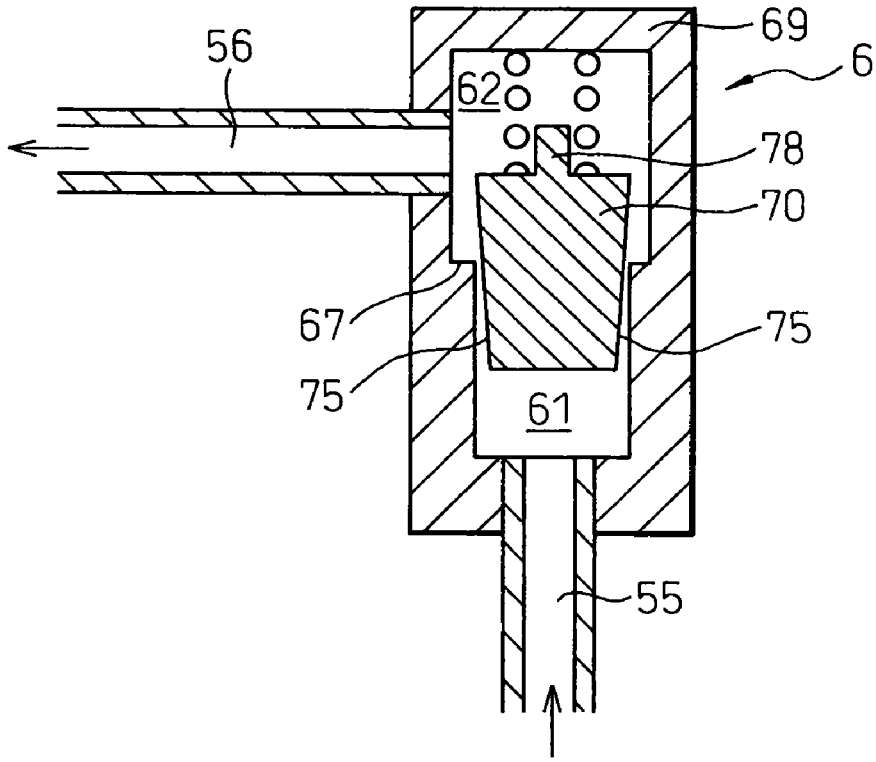
FIG. 7*a* is a substantially longitudinal sectional view of the variable-area orifice according to yet another embodiment of the invention.
Figure 7B:
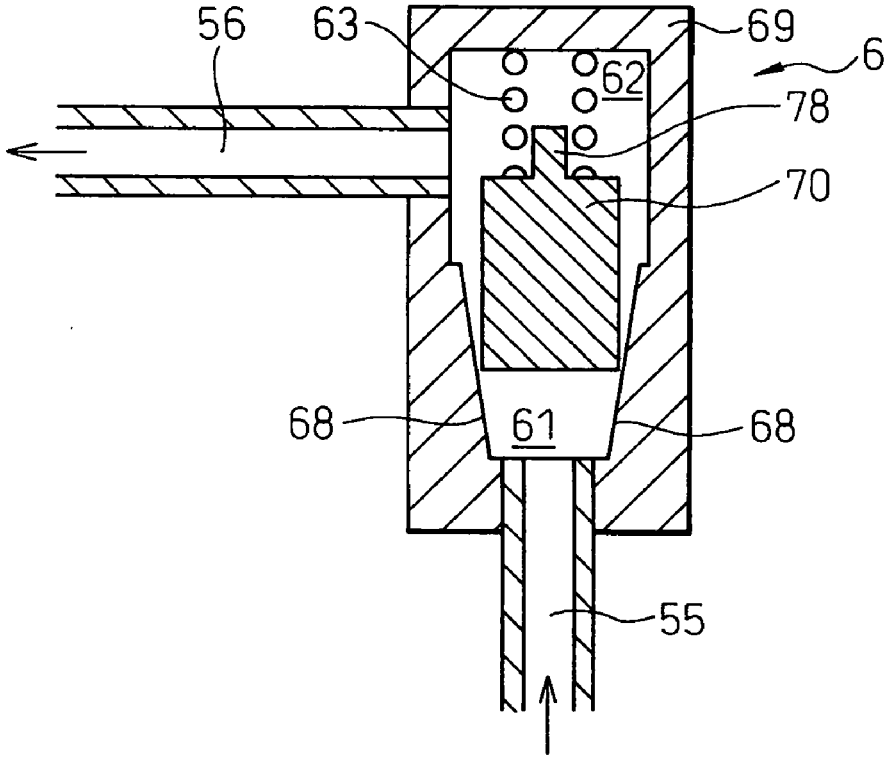
FIG. 7*b* is a substantially longitudinal sectional view of the variable-area orifice according to a further embodiment of the invention.

FIGS. 7*a* and 7*b* are substantially longitudinal cross sectional views of variable-area orifices according to still other embodiments of the invention. The sliding member 70 shown in FIG. 7*a* is solid and does not have substantially U-shaped cross section, and the communication hole 79 is not formed in the sliding member 70. In FIG. 7*a*, the side surface of the sliding member 70 is formed with a narrow taper toward the first chamber 61 from the second chamber 62. The fuel in the first chamber 61, therefore, flows into the second chamber 62 through the gap between the side surface 75 of the sliding member 70 and the inner wall of the first chamber 61. During the slide operation of the sliding member 70 toward the second chamber 62, the longer the sliding distance, the larger the gap between the side surface 75 of the sliding member 70 and the inner wall of the first chamber 61. Also, as shown in FIG. 7*b*, the side surface 75 of the sliding member 70 may not be tapered but the inner wall 68 of the first chamber 61 may be tapered. Also in the case shown in FIG. 7*b*, the longer the sliding distance of the sliding member 70, a larger gap can be formed between the side surface of the sliding member 70 and the inner wall 68 of the first chamber 61. Thus, the embodiments shown in FIGS. 7*a* to 7*b* produce the same effects as the aforementioned embodiments.

Figure 8:
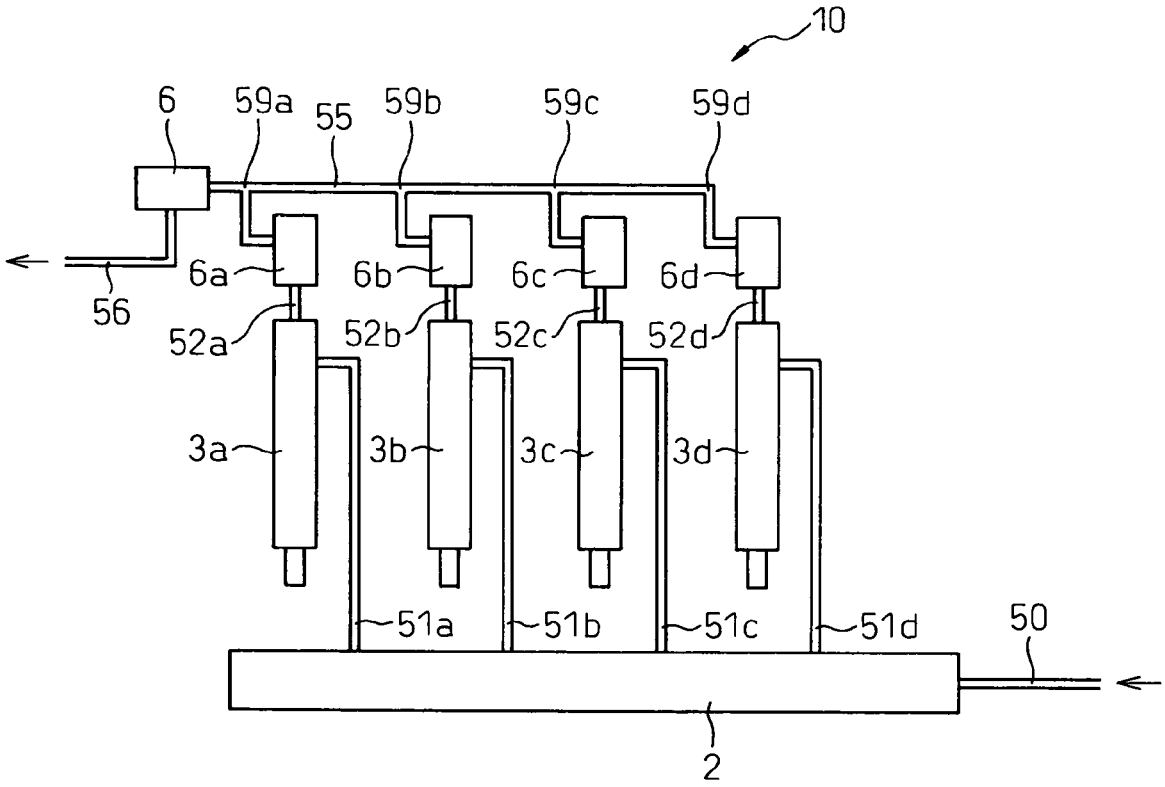
FIG. 8 is a schematic diagram showing another example of a fuel injection system of an internal combustion engine according to the invention.

FIG. 8 is a schematic diagram showing a fuel injection system of an internal combustion engine according to another embodiment of the invention. The fuel injection system 10 shown in FIG. 1 includes a single variable-area orifice 6 arranged between the common fuel discharge path 55 and the fuel return path 56. In FIG. 8, in contrast, a plurality of variable-area orifices 6*a* to 6*d* are arranged midway of branch pipes 52*a* to 52*d* extending from a plurality of injectors 3 including injectors 3*a* to 3*d*, respectively, to the common fuel discharge path 55. Specifically, the variable-area orifices 6*a* to 6*d* are arranged between the confluences 59*a* to 59*d* in the common fuel discharge path 55 and the injectors 3*a* to 3*d*, respectively. According to the embodiment shown in FIG. 8, therefore, in addition to the advantageous effects due to the provision of the single variable-area orifice 6 in the common fuel discharge path 55, an advantage is obtained in that the pressure pulsation generated in the common fuel discharge path 55 at the time of fuel injection from a given injector such as the injector 3*b* is prevented from being transmitted to the other injectors such as the injectors 3*a*, 3*c*. Thus, the variations of the amount of fuel injected by the injectors 3*a* to 3*d* can be further suppressed. A substantially similar effect is produced even in the absence of the variable-area orifice 6 between the common fuel discharge path 55 and the fuel return path 56.

According to still another embodiment of the invention which is not shown, other urging means such as an electromagnetic solenoid or a piezoelectric actuator for urging the sliding member 70 may be employed in place of the spring 63 arranged in the second chamber 62. In this case, the position of the sliding member 70 can be controlled very accurately. This invention is not limited to the plurality of the embodiments described above with reference to the accompanying drawings, but any appropriate set of the embodiments described above is included in the scope of the invention.

The invention claimed is:

1. A fuel injection system of an internal combustion engine for injecting a high-pressure fuel accumulated in a common rail from a plurality of injectors, wherein each of said injectors includes a high-pressure chamber for accumulating the fuel, a back pressure chamber into which the high-pressure fuel in said high-pressure chamber is introduced and a nozzle body arranged in said high pressure chamber, wherein said injector closes the fuel injection port by pushing down said nozzle body under the pressure of the high-pressure fuel introduced into said back pressure chamber on the one hand and said high-pressure fuel in said back pressure chamber is discharged through the fuel discharge path of said injector thereby to open said fuel injection port on the other hand, wherein a variable-area orifice is arranged in a common discharge path downstream of the confluences of all the fuel discharge paths from the injectors, and wherein an open area of said variable-area orifice is increased in response to an increase in fuel pressure in said common discharge path.

2. A fuel injection system of an internal combustion engine according to claim 1, further comprising a variable-area orifice arranged in each of the fuel discharge paths from said injectors, wherein the open area of said variable-area orifices are increased with the increase in fuel pressure in the fuel discharge paths.

3. A fuel injection system of an internal combustion engine according to claim 1, wherein said variable-area orifice is formed of a first chamber communicating with said injectors and a second chamber integrated with said first chamber and including an outlet, wherein said variable-area orifice includes a sliding member adapted to slide along the inner wall of said first chamber, and at least one communication hole is formed in the sliding surface of said sliding member for establishing communication between said first chamber and said second chamber at the time of sliding of said sliding member, wherein said variable-area orifice includes an urging means to urge the sliding means away from the second chamber, and wherein the open area of said communication hole is increased when said sliding member slides toward said second chamber under the pressure of the fuel in said fuel discharge path against the force of said urging means.

4. A fuel injection system of an internal combustion engine according to claim 3, wherein a plurality of communication holes are formed to establish communication between the first chamber and the second chamber, said communication holes in the sliding surface of said sliding member being each in the shape of circle, and wherein the inner edge of at least one of said plurality of the communication holes in the sliding surface of said sliding member and the outer edge of an adjacent communication hole in the sliding surface of said sliding member are located at substantially the same position in the sliding direction in which said sliding member slides.

5. A fuel injection system of an internal combustion engine according to claim 3, wherein said communication hole is at least a slit extending in the sliding direction.

6. A fuel injection system of an internal combustion engine according to claim 3, wherein the increasing rate of the open area of each communication hole increases with an increase the sliding distance of said sliding member.

7. A fuel injection system of an internal combustion engine according to claim 3, wherein the open area of said variable-area orifice is changed by at least one of the number, shape and size of said communication holes formed in the sliding surface of said sliding member.

8. A fuel injection system of an internal combustion engine according to claim 1, wherein said variable-area orifice is formed of a first chamber communicating said injectors and a second chamber integrated with said first chamber and including an outlet, said variable-area orifice includes a sliding member adapted to slide along the inner wall of said first chamber, at least one of the inner wall of said first chamber and the sliding surface of said sliding member is tapered, and said variable-area orifice includes an urging means to urge the sliding means away from the second chamber, and wherein when said sliding member slides toward said second chamber under the pressure of the fuel in said fuel discharge path against the force of said urging means, the clearance between the inner wall of said first chamber and the sliding surface of said sliding member is increased.

9. A fuel injection system of an internal combustion engine according to claim 3, wherein said second chamber is larger than said first chamber, and said sliding member includes a flange adapted to sealably abut the step between said first chamber and said second chamber.

10. A fuel injection system of an internal combustion engine according to claim 3, wherein said sliding member of said variable-area orifice is controlled by a drive member.

11. A fuel injection system of an internal combustion engine according to claim 1, wherein said variable-area orifice is formed of a first chamber communicating with said injectors and a second chamber integrated with said first chamber and including an outlet, wherein said variable-area orifice includes a sliding member adapted to slide along the inner wall of said first chamber, and at least one communication hole of a communication passage is formed in the inner wall of said first chamber for establishing communication between said first chamber and said second chamber at the time of sliding of said sliding member, wherein said variable-area orifice includes an urging means to urge the sliding means away from the second chamber, and wherein the open area of said communication hole is increased when said sliding member slides toward said second chamber under the pressure of the fuel in said fuel discharge path against the force of said urging means.

* * * * *